US009362607B2

(12) United States Patent
Tanc et al.

(10) Patent No.: US 9,362,607 B2
(45) Date of Patent: Jun. 7, 2016

(54) WAVEGUIDE PROPAGATION APPARATUS COMPATIBLE WITH HERMETIC PACKAGING

(71) Applicant: ASELSAN ELEKTRONIK SANAYI VE TICARET ANONIM SIRKETI, Ankara (TR)

(72) Inventors: Zafer Tanc, Ankara (TR); Eyup Tongel, Ankara (TR); Arda Ozgen, Ankara (TR)

(73) Assignee: ASELSAN ELEKTRONIK SANAYI VE TICARET ANONIM SIRKETI, Ankara (TR)

( * ) Notice: Subject to any disclaimer, the term of this patent is extended or adjusted under 35 U.S.C. 154(b) by 0 days.

(21) Appl. No.: 14/382,763

(22) PCT Filed: Jan. 23, 2013

(86) PCT No.: PCT/IB2013/050565
§ 371 (c)(1),
(2) Date: Sep. 4, 2014

(87) PCT Pub. No.: WO2013/132359
PCT Pub. Date: Sep. 12, 2013

(65) Prior Publication Data

US 2015/0061789 A1 Mar. 5, 2015

(30) Foreign Application Priority Data

Mar. 9, 2012 (TR) ..... a 2012/02709

(51) Int. Cl.
*H01P 5/107* (2006.01)
*H01P 5/103* (2006.01)

(52) U.S. Cl.
CPC ..... *H01P 5/107* (2013.01); *H01P 5/103* (2013.01)

(58) Field of Classification Search
CPC ..... H01P 5/103; H01P 5/107
USPC ..... 333/26
See application file for complete search history.

(56) References Cited

U.S. PATENT DOCUMENTS

| | | | | |
|---|---|---|---|---|
| 4,725,793 | A | 2/1988 | Igarashi | |
| 5,678,210 | A * | 10/1997 | Hannah | H04B 1/0458 333/26 |
| 6,987,429 | B2 * | 1/2006 | Shih | H01P 11/00 333/26 |
| 2002/0163397 | A1 | 11/2002 | Buck | |
| 2004/0263280 | A1 | 12/2004 | Weinstein | |
| 2009/0295494 | A1 * | 12/2009 | Carter | H01P 5/103 333/26 |
| 2012/0194303 | A1 * | 8/2012 | Pettus | H01P 1/042 333/248 |

* cited by examiner

*Primary Examiner* — Benny Lee
(74) *Attorney, Agent, or Firm* — Gokalp Bayramoglu

(57) ABSTRACT

This topic is related to a waveguide propagation apparatus, converting microstrip propagation to waveguide propagation, providing hermeticity on the mounting area, eliminating the cabling component causing degradation on the overall performance, involving at least a microwave module (2), and comprising a combination of a base part (3) and a cover part (4).

7 Claims, 2 Drawing Sheets

WAVEGUIDE PROPAGATION APPARATUS COMPATIBLE WITH HERMETIC PACKAGING

TECHNICAL FIELD

This invention is related to a waveguide propagation apparatus, mounted to a microwave module, converting microstrip propagation to waveguide propagation, and compatible with hermetic packaging.

BACKGROUND

In existing applications, microstrip propagation can be converted to waveguide propagation over the same mechanical part. The transition is provided by a printed-circuit board, of which a part outside of the waveguide is a microstrip line, whereas the part inside the waveguide is an inserted probe. However, hermeticity cannot be acquired unless a hermetic window is used at the opening of the waveguide because the transition between microstrip and waveguide propagations takes place on the same mechanical part. On the other hand, appending the hermetic window increases both complexity and cost of the structure.

In another application of the known technique, an adaption of the transition method between coaxial and waveguide propagations is stated. The coaxial connector of the structure and the microwave module are linked via a cabling component, hence, the transition between microstrip and waveguide propagations is achieved in a roundabout way. Despite the hermeticity that is attained at the module side, a degradation at the overall performance is inevitable because of the cabling component holding the connection between the transition structure and the microwave module. The cabling component causes an increment in a noise factor of the system when placed at the input of the microwave module, whereas a decrement in amplitude of the output power occurs when the cabling component is placed at the output.

In a known technique, a waveguide to microstrip transition module is mentioned in a United States patent document U.S. Pat. No. 5,202,648 (A). This module transmits electromagnetic energy received between the waveguide and the signal processing circuit. The module consists of a waveguide, a circuit panel and a microstrip line. The microstrip line directed by the waveguide is linked to the signal processing circuit. The system is covered hermetically to surround the circuit panel.

In another known technique, a waveguide system including a tuning element, an adaptor, a waveguide and pin link elements is mentioned in a United States patent document U.S. Pat. No. 6,549,106 (B2).

SUMMARY OF THE INVENTION

An objective of this invention is to provide a waveguide propagation apparatus, which is mounted to a microwave module having a coaxial connector.

Another objective of this invention is to provide a waveguide propagation apparatus, which is compatible with hermetic packaging.

Another objective of this invention is to provide a waveguide propagation apparatus, which converts microstrip propagation to waveguide propagation.

Another objective of this invention is to provide a waveguide propagation apparatus, which eliminates the cabling component causing degradation on the overall performance.

BRIEF DESCRIPTION OF THE DRAWINGS

In order to succeed in the objectives of this invention, a produced waveguide propagation apparatus is shown in the attached figures, which are.

Figure 1:
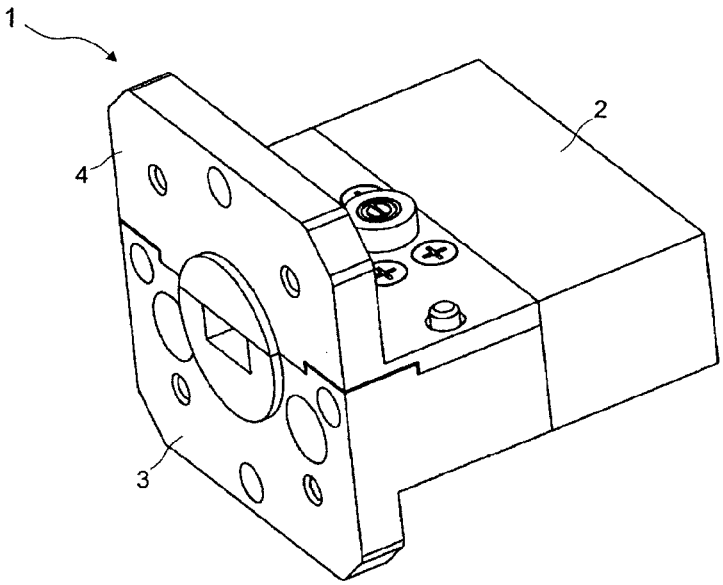
FIG. 1. The perspective view of the waveguide propagation apparatus.

Components shown in the figures are enumerated one by one and the denotations of these numbers are given below:

1. Waveguide propagation apparatus
2. Microwave module
2.1 Conductive pin
2.2 Solder ring
2.3. Solder ring hole
2.4 Module guiding pin
2.5 Connector mounting hole
2.6 First module mounting screw hole
2.7 First module guiding pin hole
3. Base Part
3.1 Second module guiding pin hole
3.2 Second module mounting screw hole
3.3 Waveguide groove
3.4 Conductive pin bearing
3.5. Conductive pin hole
3.6 welding hole
3.7 Apparatus guiding pin hole
3.8 Apparatus guiding pin
3.9 Apparatus mounting screw hole
4. Cover Part
4.1. Apparatus guiding pin hole
4.2 Apparatus mounting screw
4.3 Microwave tuning screw
4.4 Microwave tuning screw hole
UR: The area of the solder ring hole
UG: The area of the solder ring hole mounted with the solder ring

DETAILED DESCRIPTION OF THE INVENTION

Figure 2:
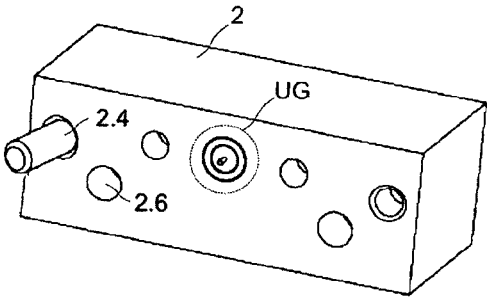
FIG. 2. The perspective view of the microwave module.
Figure 3:
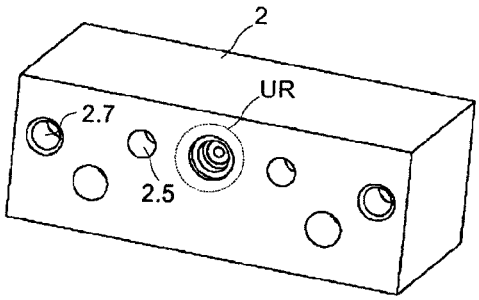
FIG. 3. The perspective view of the microwave module.
Figure 4:
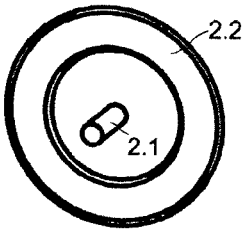
FIG. 4. The enlarged view of a solder ring hole mounted with a solder ring shown in FIG. 2.
Figure 5:
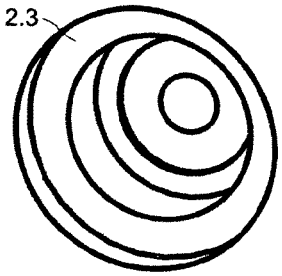
FIG. 5. The enlarged view of the solder ring hole shown in FIG. 3.
Figure 6:
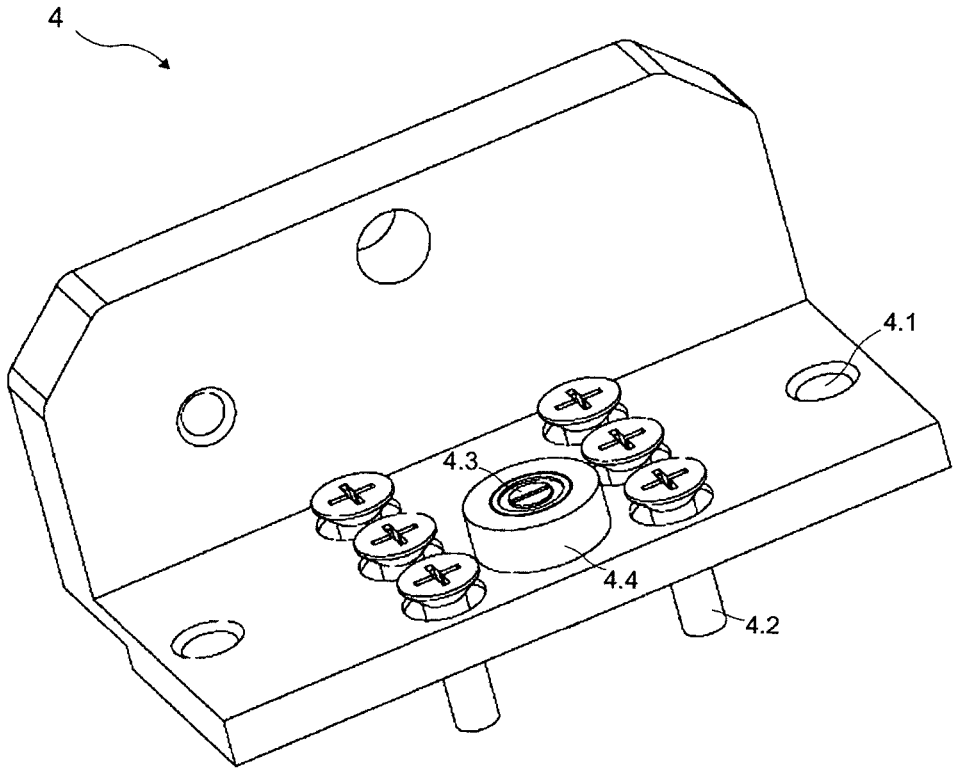
FIG. 6. The perspective view of the cover part.
Figure 7:
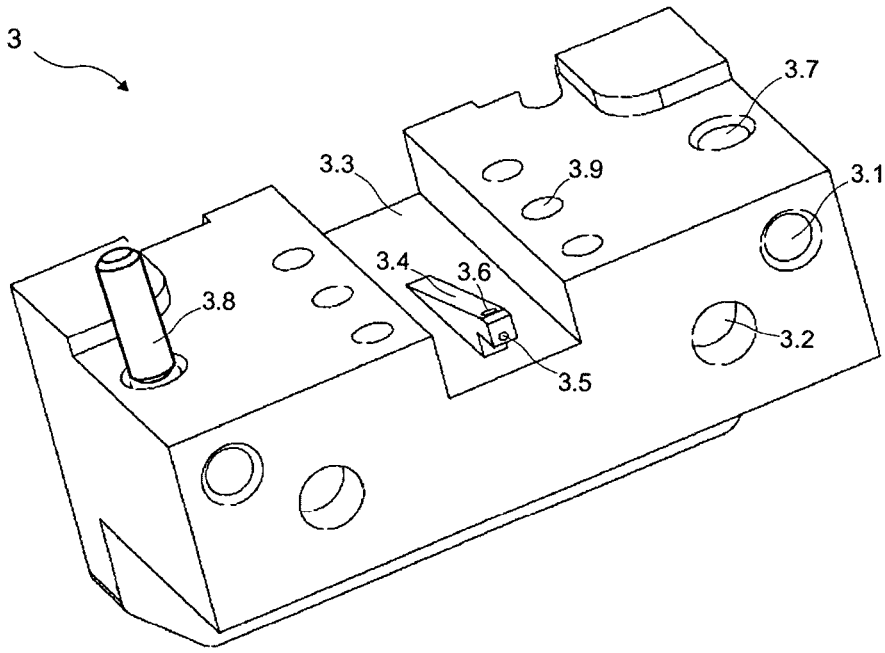
FIG. 7. The perspective view of the base part.

Referring to FIGS. 1 to 7, a waveguide propagation apparatus (1), converting microstrip propagation to waveguide propagation, and eliminating the cabling component causing degradation on the overall performance, principally consists of, at least a microwave module (2) transmitting/receiving RF signal, at least a conductive pin (2.1), installed in the microwave module (2), linked to a microstrip line enabling electromagnetic propagation, and making signal transfer possible from/to the outer surface, at least a solder ring (2.2), mounting the conductive pin (2.1) to the microwave module (2) by surrounding the conductive pin (2.1) when the at least a solder ring (2.2) is melted, and ensuring hermeticity of the mounting area, wherein the mounting area comprises at least a solder ring hole (2.3), the at least a solder ring hole (2.3) bears the solder ring (2.2), has a definite depth and a diameter larger than the diameter of the solder ring (2.2), and is located on the side wall of the microwave module (2), at least a module guiding pin (2.4) configured to mount the microwave module (2) in a fixed manner, at least a connector mounting hole (2.5) providing an attachment of a coaxial connector by a screw, the coaxial connector is used for validating the functionality of the microwave module (2) before the waveguide propagation apparatus (1) is mounted to the microwave module (2), at least a first module mounting screw hole (2.6) located on the side wall of the microwave module and configured to accept a second screw, at least a first module guiding pin hole (2.7), accepting the module guiding pin (2.4), and located on the side wall of the microwave module (2), at least a base part (3), configured to provide electromagnetic propagation, and mounted to the microwave module (2), at least a second module guiding pin hole (3.1) connected to the first module guiding pin hole (2.7) by accepting the module guiding pin (2.4) to make the alignment of the base part (3) with respect to the microwave module (2), at least a second module mounting screw hole (3.2) connected to the first module mounting screw hole (2.6) by accepting a third screw to disable any movement of the base part (3) after being mounted to the microwave module (2), at least a waveguide groove (3.3) aligned with the conductive pin (2.1) when the base part (3) is mounted to the microwave module (2), at least a conductive pin bearing (3.4), located on the waveguide groove (3.3), and close to the microwave module (2) to maintain the conductive pin (2.1) when the base part (3) is mounted to the microwave module (2), at least a conductive pin hole (3.5) accepting the conductive pin (2.1), at least a welding hole (3.6) located on the top of the conductive pin bearing to improve the electrical conductivity by welding after the conductive pin (2.1) is inserted into the conductive pin hole (3.5), at least a first apparatus guiding pin hole (3.7) located on the upper surface of the base part (3) and the upper surface of the base part (3) intersecting the waveguide groove (3.3), at least an apparatus guiding pin (3.8) accepted by the first apparatus guiding pin hole (3.7) to make necessary alignments, at least an apparatus mounting screw hole (3.9) located on the upper surface of the base part (3) and close to the waveguide groove (3.3), at least a cover part (4) mounted on the base part (3) to constitute the top side of the waveguide groove (3.3), at least a second apparatus guiding pin hole (4.1) concentric with the first apparatus guiding pin hole (3.7) to make the alignment of the cover part (4) with respect to the base part (3) by accepting the apparatus guiding pin (3.8), at least an apparatus mounting screw (4.2) uniting the base part (3) and the cover part (4) by screwing into the apparatus mounting screw hole (3.9), at least a microwave tuning screw (4.3) minimizing the return and insertion losses of the signal transmitted/received by the conductive pin (2.1), at least a microwave tuning screw hole (4.4), accepting the microwave tuning screw (4.3), and located on the upper surface of the cover part (4).

In an application of this invention, the conductive pin (2.1) is installed on one of the side walls of the microwave module (2), the microwave module (2) is capable of transmitting/receiving RF signal. The conductive pin (2.1) is linked to a microstrip line which is located in the microwave module (2) and is enabling electromagnetic propagation; hence, the conductive pin (2.1) makes signal transfer possible from/to the outer surface. The conductive pin (2.1) is mounted to the microwave module (2) by the solder ring (2.2) which performs this action by surrounding the conductive pin (2.1) when it is melted; moreover, the mentioned action ensures hermeticity with the microwave module (2) on the mounting area. At the time of the mounting of the conductive pin (2.1), the solder ring (2.2) is held in the solder ring hole (2.3) located on the side wall of the microwave module (2). The solder ring hole (2.3) has a definite depth and a diameter larger than the diameter of the solder ring (2.2). The solder ring (2.2) is heated, and then, melted to fix and position the conductive pin (2.1) by surrounding it. After that, the base part (3) is mounted to the microwave module (2). For this process, the conductive pin (2.1) is accepted by the conductive pin hole (3.5) while the module guiding pin (2.4) passes through the second module guiding pin hole (3.1) and falls into the first module guiding pin hole (2.7). Notice that, the alignment of the base part (3) is procured by inserting the module guiding pin (2.4) into the first module guiding pin hole (2.7). Afterwards, the electrical conductivity between the conductive pin (2.1) and the conductive pin bearing (3.4) is improved by soldering into the welding hole (3.6) of the conductive pin bearing (3.4). In order to finish the mounting to the microwave module (2), the base part (3) is screwed into the first module mounting screw hole (2.6). Furthermore, the cover part (4) is aligned with respect to the base part (3) by the apparatus guiding pin (3.8). Then, the base part (3) and the cover part (4) are connected with each other by the apparatus mounting screw (4.2). The microwave tuning screw (4.3) minimizes the return and insertion losses of the signal transmitted/received by the conductive pin (2.1).

In another application of this invention, at least a coaxial connector can be attached to the microwave module (2) by screwing into the connector mounting hole (2.5) on the side wall of the microwave module (2). Therefore, the functionality of the microwave module (2) is validated before the mounting of the waveguide propagation apparatus (1) to the microwave module (2).

The above are exemplary applications of carrying out this invention, a waveguide propagation apparatus (1) compatible with hermetic packaging. It is to be understood that the invention is not limited to the embodiments stated above, however, corresponding modifications and variations are within the scope of the following claims.

The invention claimed is:

1. A waveguide propagation apparatus, converting microstrip propagation to waveguide propagation, and eliminating the cabling component causing degradation of the overall performance, comprising:

a microwave module transmitting or receiving RF signal;

a conductive pin, installed in the microwave module, linked to a microstrip line enabling electromagnetic propagation, and making signal transfer possible from or to an outer surface of the conductive pin;

a solder ring mounting the conductive pin to the microwave module by surrounding the conductive pin when the solder ring is melted, and ensuring hermeticity of a mounting area; wherein the mounting area comprises a solder ring hole, the solder ring hole bears the solder ring, has a definite depth and a diameter larger than the diameter of the solder ring, and is located on a side wall of the microwave module;

a module guiding pin configured to mount the microwave module;

a connector mounting hole configured to connect with a coaxial connector by a first screw, wherein the coaxial connector is used to validate the functionality of the microwave module before the waveguide propagation apparatus is fixed to the microwave module;

a first module mounting screw hole located on the side wall of the microwave module and configured to accept a second screw;

a first module guiding pin hole, accepting the module guiding pin, and located on the side wall of the microwave module;

a base part mounted to the microwave module;

a second module guiding pin hole connected to the first module guiding pin hole by accepting the module guiding pin to make the alignment of the base part with respect to the microwave module;

a second module mounting screw hole connected to the first module mounting screw hole by accepting a third screw to disable any movement of the base part after being mounted to the microwave module;

a waveguide groove aligned with the conductive pin when the base part is mounted to the microwave module;

a conductive pin bearing, found on the waveguide groove, and close to the microwave module to maintain the conductive pin when the base part is mounted to the microwave module;

a conductive pin hole accepting the conductive pin;

a welding hole located on the top of the conductive pin bearing to improve the electrical conductivity by welding after the conductive pin is inserted into the conductive pin hole;

a first apparatus guiding pin hole located on an upper surface of the base part and the upper surface of the base part intersecting the waveguide groove;

an apparatus guiding pin accepted by the first apparatus guiding pin hole to make necessary alignments;

an apparatus mounting screw hole located on the upper surface of the base part and close to the waveguide groove;

a cover part mounted on the base part to constitute a top side of the waveguide groove;

a second apparatus guiding pin hole concentric with the first apparatus guiding pin hole to make the alignment of the cover part with respect to the base part by accepting the apparatus guiding pin;

an apparatus mounting screw uniting the base part and the cover part by screwing into the apparatus mounting screw hole;

a microwave tuning screw minimizing the return and insertion losses of the signal transmitted or received by the conductive pin;

a microwave tuning screw hole, accepting the microwave tuning screw, and located on the upper surface of the cover part.

2. The waveguide propagation apparatus of claim 1, wherein the conductive pin is installed on the side wall of the microwave module.

3. The waveguide propagation apparatus of claim 1, wherein the solder ring mounts the conductive pin to the microwave module, and ensures hermeticity with the microwave module on the mounting area.

4. The waveguide propagation apparatus of claim 1, wherein the microwave tuning screw minimizes the return and insertion losses of the signal transmitted or received by the conductive pin.

5. The waveguide propagation apparatus of claim 1, wherein the module guiding pin hole and the module guiding pin hole accepts the module guiding pin when the base part is mounted to the microwave module.

6. The waveguide propagation apparatus of claim 1, wherein the base part and the cover part are connected with each other by screwing the apparatus mounting screw into the apparatus mounting screw hole after the cover part is aligned on the base part.

7. The waveguide propagation apparatus of claim 1, wherein the apparatus guiding pin aligns the cover part on the base part in a fixed manner.

* * * * *